US007469448B1

(12) United States Patent
Forester et al.

(10) Patent No.: US 7,469,448 B1
(45) Date of Patent: Dec. 30, 2008

(54) TENSIONING HINGE

(75) Inventors: George Forester, 16580 Maple Cir., Lake Oswego, OR (US) 97034; Peter V. H. Serrell, Lake Oswego, OR (US)

(73) Assignee: George Forester, Lake Oswego, OR (US)

( * ) Notice: Subject to any disclaimer, the term of this patent is extended or adjusted under 35 U.S.C. 154(b) by 399 days.

(21) Appl. No.: 11/296,054

(22) Filed: Dec. 6, 2005

Related U.S. Application Data

(60) Provisional application No. 60/634,197, filed on Dec. 7, 2004.

(51) Int. Cl.
*E05D 3/10* (2006.01)

(52) U.S. Cl. ..... 16/366

(58) Field of Classification Search ..... 16/366, 16/369, 370, 227, 337, 338, 339, 340, 273; 403/119, 220, 341; 160/135; 602/16, 26
See application file for complete search history.

(56) References Cited

U.S. PATENT DOCUMENTS

| | | | | | |
|---|---|---|---|---|---|
| 1,888,345 | A | * | 11/1932 | Cummings | 16/370 |
| 2,877,033 | A | * | 3/1959 | Koetke | 403/95 |
| 3,425,766 | A | * | 2/1969 | Crisera | 312/294 |
| 3,497,909 | A | * | 3/1970 | Davis | 16/193 |
| 3,939,529 | A | * | 2/1976 | Davis | 16/249 |
| 4,628,916 | A | * | 12/1986 | Lerman et al. | 602/16 |
| 4,692,050 | A | * | 9/1987 | Kaufman | 403/3 |
| 5,410,779 | A | * | 5/1995 | Esman et al. | 16/370 |
| 5,741,221 | A | * | 4/1998 | Wetz et al. | 602/26 |
| 6,421,878 | B1 | * | 7/2002 | Kaneko et al. | 16/330 |
| 6,918,160 | B1 | * | 7/2005 | Clark | 16/370 |

* cited by examiner

*Primary Examiner*—Chuck Y. Mah
(74) *Attorney, Agent, or Firm*—Blakely Sokoloff Taylor & Zafman LLP

(57) ABSTRACT

A hinge assembly enables the setting of elements attached to the hinge assembly to any angle within the range of motion of the hinge assembly without the use of other mechanisms or parts.

5 Claims, 4 Drawing Sheets

TENSIONING HINGE

RELATED APPLICATIONS

This application claims the benefit of priority to U.S. Provisional Application No. 60/634,197, filed Dec. 7, 2004.

FIELD

Embodiments of the invention relate to a hinge assembly, and more particularly to a tensioning hinge.

BACKGROUND

Hinges have been known for ages, and can be seen employed in anything from doors, to box lids, to draw bridges. Hinges allow the movement of one element secured to another to be moved relative to the other element. Thus, a door can be moved relative to the wall to which it is secured, or the box lid relative to the box lid to which it is attached. However, hinges traditionally have a free range of motion from one set position to another (namely, from closed to open), and cannot hold a relatively fixed position within the range from closed to open. The holding, for example, of a door at a position other than wide open or closed is completely arbitrary, and a wind, for example, could easily change its position. Similarly, box lids are known to open and hold to certain positions, but require extra mechanisms to enable the holding to a position other than open or closed.

BRIEF DESCRIPTION OF THE DRAWINGS

The following description includes discussion of various figures having illustrations given by way of example of implementations of embodiments of the invention. The drawings should be understood by way of example, and not by way of limitation.

DETAILED DESCRIPTION

As used herein, references to one or more "embodiments" are understood as describing a particular feature, structure, or characteristic included in at least one implementation of the invention. Thus, phrases such as "in one embodiment" or "in an alternate embodiment" appearing herein describe various embodiments and implementations of the invention, and do not necessarily all refer to the same embodiment. However, they are also not necessarily mutually exclusive. Descriptions of certain details and implementations follow, including a description of the figures, which may depict some or all of the embodiments described below, as well as discussing other potential embodiments or implementations of the inventive concepts presented herein.

A hinge may be constructed with cross link attachments. The cross-linking can provide a tensioning function of the hinge to enable the hinge to open and hold to any angle, or substantially any angle, within the range of motion of the hinge. The cross links are attached to bases with pivot screws tightened "just enough," or to a point that allows motion in the hinge and secures the component parts of the hinge assembly. An optimal or near optimal setting for the pivot screw allows the pivot screw to be held in place with a set screw in the same threaded hole as the pivot screw, the set screw to be inserted from the end of the threaded hole opposite the end into which the pivot screw is inserted, to result in the bottom of the set screw being against the bottom of the pivot screw to hold the pivot screw. A pair of domed or Belleville washers may be placed between the pivot screw head and the link to provide the motion with tension. A plastic/nylon washer may be placed between the link and the base to which the hinge is attached. As used herein, components may refer to elements of an assembly. As used herein, components may be referred to as being placed or disposed in a location, or disposed adjacent to or between other components. When referring to a component being placed or being positioned, it will be understood that the component could also be referred to as being disposed in a particular place or position.

Figure 1A:
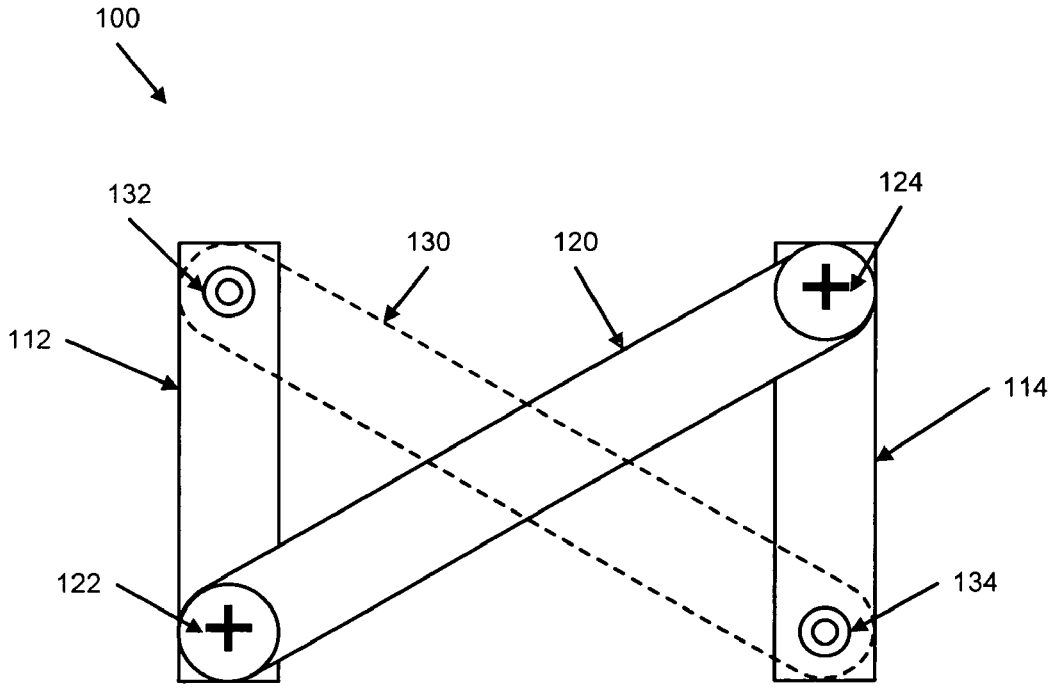
FIGS. 1A-B are block diagrams of an embodiment of a tensioning hinge in different positions within a range of motion of the hinge.
Figure 1B:
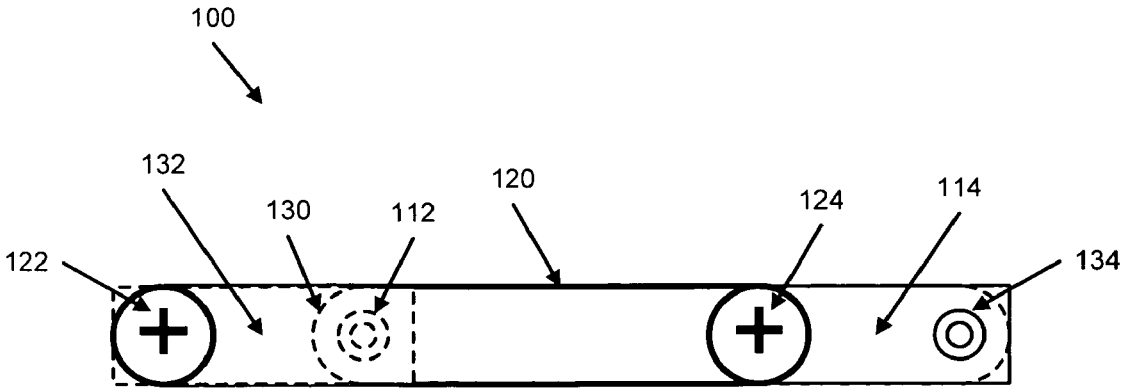

FIGS. 1A-B are block diagrams of an embodiment of a tensioning hinge in different positions within a range of motion of the hinge. Hinge assembly 100 includes cross-links 120 and 130, which are secured to bases 112 and 114. As used herein, secured refers to physical coupling of one component or assembly to another. Secured may be considered to be comparable to other phrases, for example, attached, affixed, etc. The terms secured and securing may be used herein for purposes of consistency of discussion. The selection of one term over another should not be interpreted as limiting or narrowing. Note that secured does not require a absolute fixation of position, as the hinge assembly provides a range of motion to bases 112 and 114 with respect to each other. Assuming a vertical orientation on FIG. 1 (other orientations could be used), with the components seen on a front face of hinge assembly 100, pivot screw 122 secures one end of link 120 to a lower portion of a front face of base 112, and pivot screw 124 secures the other end of link 120 to an upper portion of a front face of base 114. Although not shown in FIG. 1, similar pivot screws can secure one end of link 130 (in a background with respect to link 120) to an upper portion of a distal face of base 112, and the other end of link 130 to a lower portion of a distal face of base 114. Thus, links 120 and 130 are secured to bases 112 and 114 in a cross-link manner.

In one embodiment, hinge assembly 100 includes set screw 132 in an upper portion of base 112. Set screw 132 may be a set screw that has threading around the outer portion of the screw, without a screw head that extends beyond the threading. Typically, set screw 132 will include a portion that protrudes into the cylindrical body of set screw 132 to provide facets for controlling the rotation of set screw 132 and its motion along threads. For example, many set screws include a hex indentation. Others may include a Philip's indentation. In one embodiment hinge assembly 100 further includes set screw 134 in a lower portion of base 114. Set screws 132-134 may be installed within a same threaded hole used by pivot screws that secure link 130 to bases 112-114. In a similar fashion, set screws (not shown) could be included within the same threaded holes used install pivot screws 122-124 to secure link 120 to bases 112-114.

Specifically with reference to the individual positions shown, FIG. 1A illustrates hinge assembly 100 when bases 112 and 114 are parallel to each other. FIG. 1B illustrates hinge assembly 100 when bases 112 and 114 are in the same plane. In FIG. 1B, link 130 is shown behind link 120, as it has disappeared from the frontal view of hinge assembly 100 as illustrated in FIG. 1B.

The securing of links 120 and 130 in a cross-link fashion enables hinge assembly 100 to enable bases 112 and 114 to be physically secured to one another, while allowing motion of one base with respect to the other. The motion of the hinge assembly with respect to the bases is further described below. In one embodiment hinge assembly 100 includes domed washers, or Belleville washers between the heads of pivot screws 122-124 and link 120. In one embodiment two or more Belleville washers are used. In one embodiment two washers are placed with the cone ends facing each other. The use of Belleville washers, and especially in the cone-to-cone orientation, can provide tension that enables hinge assembly 100 to be positioned (e.g., by manual or automated movement of the bases to which hinge assembly 100 is secured) to somewhere within the range of motion of hinge assembly 100 (nominally 360 degrees in the plane of FIG. 1, with the use of stopping mechanisms possibly put in place to limit the range of motion), and the hinge assembly stays in the position to which it is moved.

With the double cross linked hinge assembly, hinge assembly 100 may allow nearly 360 degree motion of bases 112-114 (or any assembly or mechanism secured by links 120 and 130) in the plane of links 120 and 130, while temporarily fixing hinge assembly 100 to whatever position to which it is opened. For example, if hinge assembly 100 is adjusted by opening to approximately a 60 degree angle between bases 112-114, relative to an axis formed by the longitudinal centers of bases 112 and 114, hinge assembly 100 will hold the bases at approximately the 60 degree angle, even if shaken or vibrated. Thus, a hinge may be easily opened, or adjusted, and set to an open or closed position by hand, and without the need for further latching or fixing mechanisms, hinge assembly 100 itself fixes the attached bases at the position to which hinge assembly 100 is adjusted or opened.

The benefit of the hinge design of hinge assembly 100 is not dependent on size. For an example, in one embodiment FIG. 1 illustrates a hinge of approximately 1 inch of distance between pivot screws. A hinge of the same or similar design, operating on the same principles, could be as small as microscopic, or as large as a railroad bridge and provide the functionality described herein. The size and tension of the set screws and pivot screws may be adjusted for attachments or bases of different size to allow the described operation with hinges of varying sizes. The size of a desired hinge assembly may be adjusted to correspond to a size/weight of an assembly/baseplate to be controlled by the hinge.

Figure 2:
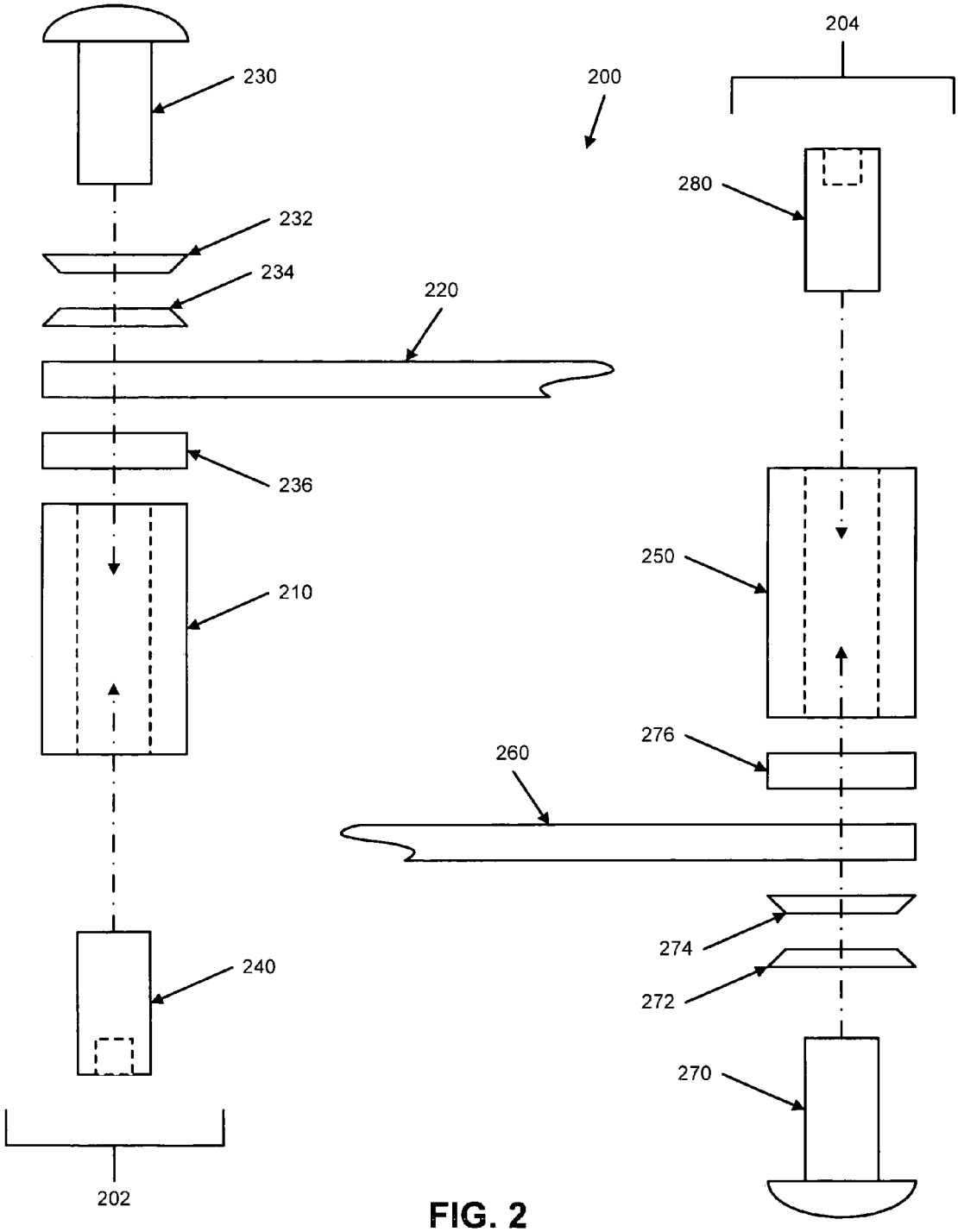
FIG. 2 is a block diagram of an embodiment of a tensioning hinge component assembly.

FIG. 2 is a block diagram of an embodiment of a tensioning hinge component assembly. FIG. 2 represents one embodiment of a top view of the hinge assembly of FIG. 1A. Baseplate 210 is illustrated with a threaded hole through a portion of the baseplate. As used herein, baseplate refers to any base, assembly, component, etc., which may be secured to hinge assembly 200. The term baseplate is used hereinafter by way of simplicity in description, and not by way of limitation.

Component assembly 202 illustrates one example of elements used to secure link 220 to baseplate 210. Component assembly 202 includes set screw 240, which may be inserted at least partway into the threaded opening of baseplate 210. Set screw 240 is illustrated with the driving mechanism extending into the body of set screw 240. In one embodiment the length of set screw 240, pivot screw 230, and/or baseplate 210 may be adjusted to align each element. For example, the size of the link may be controlled, as may be the length of the set screw and pivot screw. In one embodiment, the depth of the threaded hole in baseplate 210 is controlled to the length of pivot screw 230, and the need for set screw 240 may be eliminated.

Component assembly 202 includes pivot screw 230 to secure link 220 to baseplate 210. Component assembly 202 further includes Belleville washers 232-234 between the head of pivot screw 230 and baseplate 210. The slope of Belleville washers 232-234 is dependent on the implementation, and can be determined for each implementation individually. In one embodiment two Belleville washers are used, with the crown or domed portion facing each other. When component assembly 202 is secured to baseplate 210, the crown of Belleville washer 232 will compress against the crown of Belleville washer 234, and provide tension between pivot screw 230 and link 220.

In one embodiment component assembly 202 further includes spacer or washer 236 between link 220 and baseplate 210. Spacer 236 may be of any material, and in one embodiment is constructed of nylon. Spacer 236 may add further tension to component assembly 202 that enables the tensioning motion of hinge assembly 200. In one embodiment, one or more Belleville washers may be used between the head of pivot screw 230 and one or more additional Belleville washers may be used as spacer 236.

Figure 3:
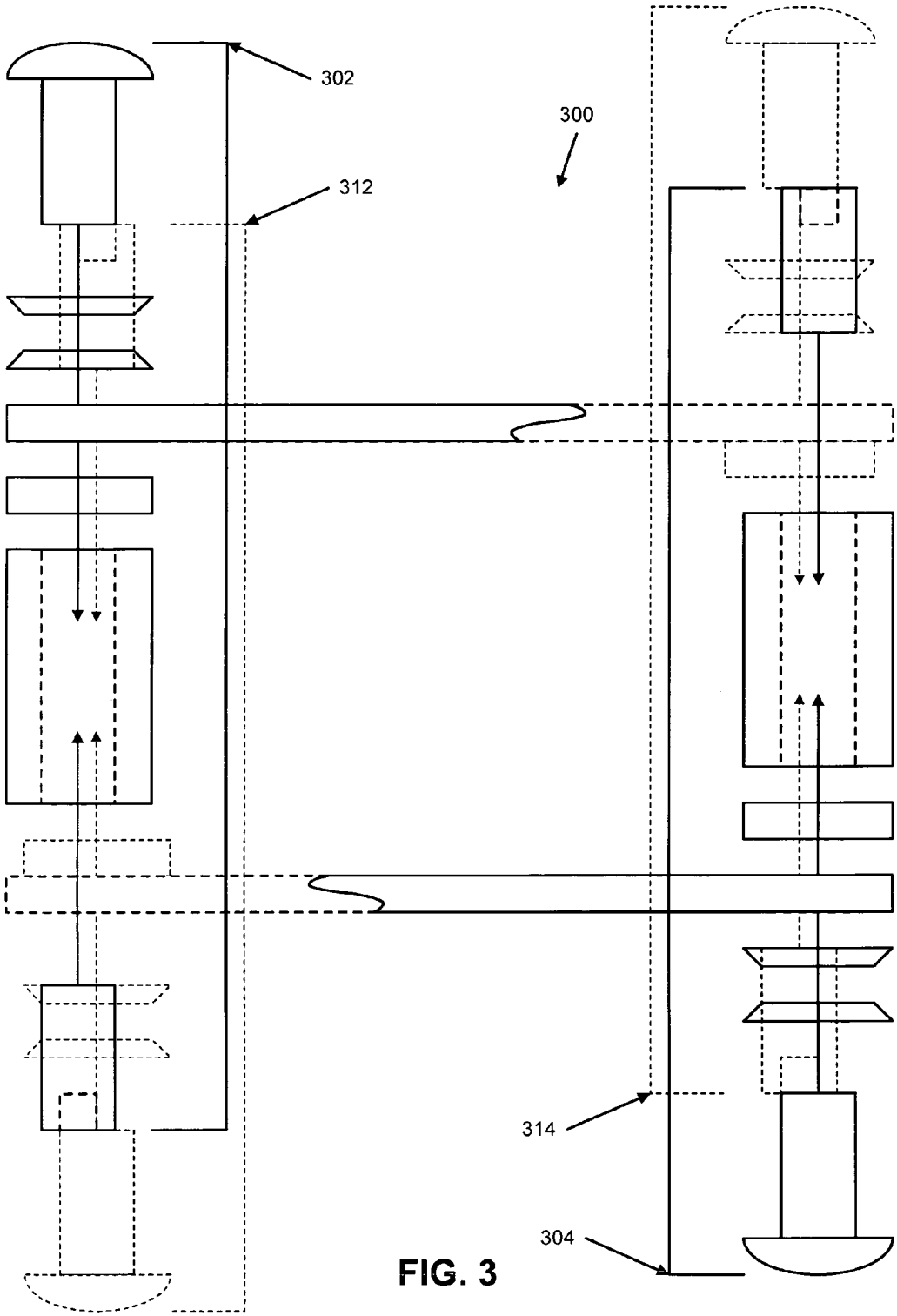
FIG. 3 is a block diagram of an embodiment of tensioning hinge component assemblies.

Component assembly 204 is similar to component assembly 202, and secures link 260 to baseplate 250. Link 260 provides the cross-linking with link 220, and further component assemblies would secure the other end of links 220 and 260 to the baseplates, as illustrated in FIG. 3, and discussed below. Specifically, component assembly 204 includes pivot screw 270 that secures link 260 and enables the pivoting motion of link 260 with respect to baseplate 250. Pivot screw 270 secures against link 260, with Belleville washers 272-274 between the head of pivot screw 270 and link 260. Link 260 may be spaced from baseplate 250 by spacer 276. Set screw 280 may abut the end of pivot screw 270 distal from the head in the threaded hole of baseplate 250.

FIG. 3 is a block diagram of an embodiment of tensioning hinge component assemblies. Hinge assembly 300 includes component assemblies 302 and 304, which provide examples of hinge assemblies 202-204 of FIG. 2. Hinge assembly 300 further includes component assemblies 312-314, which are depicted as being in a background of FIG. 3 with respect to component assemblies 302-304. Component assembly 312 is comparable to component assembly 304, and secures the opposite end of the link secured by component assembly 304 to the other baseplate. Similarly, component assembly 314 is comparable to component assembly 302, and secures the opposite end of the link secured by component assembly 302 to the other baseplate. Thus, four component assemblies can be used to secure the two links to the two baseplates. The resulting hinge assembly 300 is comparable to hinge assembly 100 of FIG. 1.

Figure 4A:
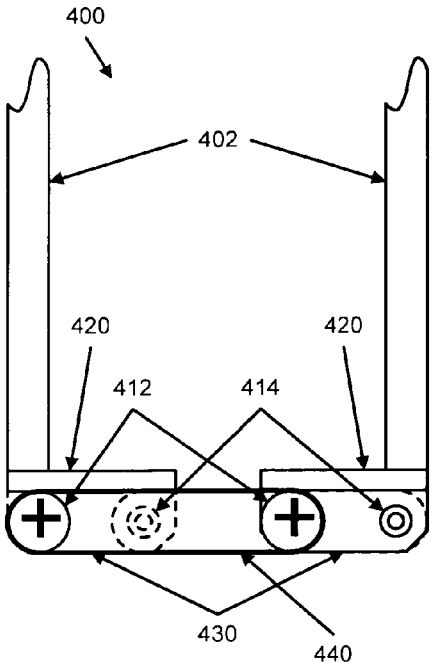
FIGS. 4A-C are block diagrams of an embodiment of a tensioning hinge with stops attached to baseplates, the hinge in different positions within a range of motion of the hinge.
Figure 4C:
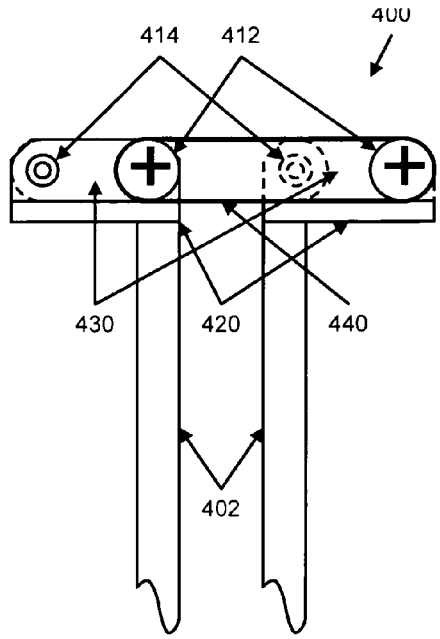
Figure 4B:
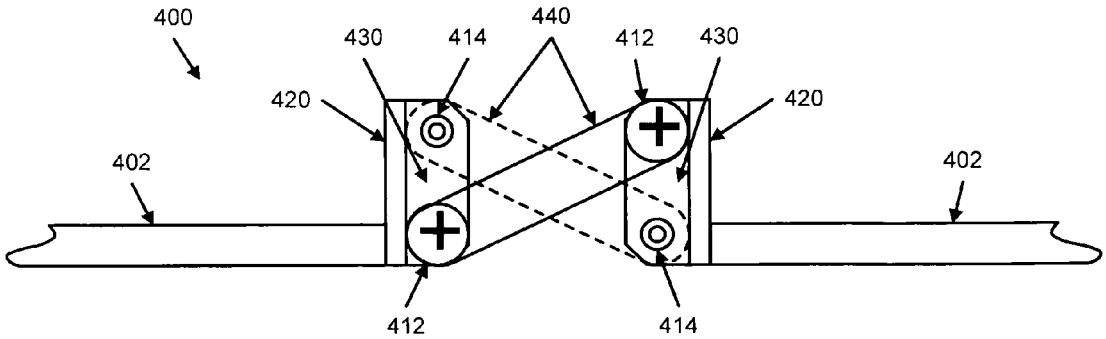

FIGS. 4A-C are block diagrams of an embodiment of a tensioning hinge with stops attached to baseplates, the hinge in different positions within a range of motion of the hinge. FIG. 4 illustrates hinge assembly 400, which may be a hinge assembly according to any embodiment described herein. Hinge assembly 400 includes baseplates 402, which have baseplate arms 430. Baseplate arms 430 may be a single piece with baseplates 402 (e.g., machined as a single piece), or may be attached via any attachment mechanism (e.g., permanent such as epoxy, glue, welding, rivets; semi-permanent such as screws; etc.). In one embodiment baseplate arms 430 include stops 420, which may limit the range of motion of hinge assembly 400, and/or may provide selected positions to which hinge assembly 400 can be set.

Hinge assembly 400 includes links 440 to secure one baseplate 402 to the other. The opposite ends of link 440 are secure to opposite baseplate arms 430 with pivot screws 412, including one or more Belleville washers between the heads of pivot screws 412 and link 440. The one or more Belleville washers may be referred to herein as being a Belleville washer assembly, and should be understood as referring to a single Belleville washers, a pair of Belleville washers in any arrangement, or more than two Belleville washers in any arrangement. Also, shown are set screws 414, in an embodiment where set screws are used.

Specifically regarding FIG. 4A, hinge assembly 400 is illustrated holding baseplates 402 parallel to each other, at what will be referred to for purposes of discussion here as angle 0 degrees. If FIG. 4A represents angle 0 degrees, FIG. 4B represents hinge assembly 400 with baseplates 402 in the same plane, with the left section of hinge assembly 400 at angle −90 degrees, and the right section of hinge assembly 400 at angle +90 degrees, assuming that clockwise movement represents positive angular progression. Note that the hinge assembly will move in mirror movement on the right and left section. Thus, if the left section is moved −30 degrees, by virtue of the cross-linking, the right section will be moved +30 degrees, and so forth. FIG. 4C illustrates hinge assembly 400 with baseplates 402 held at 180 degrees. Thus, the motion of hinge assembly 400 can be from 0 degrees of FIG. 4A at any angle to 180 degrees of FIG. 4C.

Besides what is described herein, various modifications may be made to the disclosed embodiments and implementations of the invention without departing from their scope. Therefore, the illustrations and examples herein should be construed in an illustrative, and not a restrictive sense. The scope of the invention should be measured solely by reference to the claims that follow.

What is claimed is:

1. A hinge assembly comprising:

a pair of bases, each base having a longitudinal length with substantially the same size, and each base having upper and lower portions, and each base having a front face and a distal face;

a pair of links cross-attached to the pair of bases, with one end of the first link attached to an upper portion of the front face of the first base and the other end attached to a lower portion of the front face of the second base, and one end of the second link attached to a lower portion of the distal face of the first base and the other end attached to an upper portion of the distal face of the second base, allowing the bases to pivot with respect to each other, where the bases are moveable and self-holding in position at any angle from parallel to each other to being in the same plane as each other, where each link has a longitudinal length greater than the longitudinal lengths of the bases, providing a gap between the bases when the assembly is moved to place the bases in the same plane;

four pivot screws, one screw to attach each of the two ends of each of the two cross-attached links to the bases, by being threaded through holes on the bases and links at the positions where the bases and links are attached to one another; and four Belleville washer assemblies, one Belleville washer assembly secured between a head of each pivot screw and the link which the screw attaches.

2. The hinge assembly of claim 1, wherein the Belleville washer assembly further comprises:

a pair of Belleville washers disposed with crown ends of the Belleville washers adjacent to each other.

3. The hinge assembly of claim 1, further comprising:

four set screws, one set screw for each pivot screw, where each set screw is threaded into the hole through which the associated pivot screw is threaded, from a direction opposed to the direction in which the associated pivot screw is threaded.

4. The hinge assembly of claim 1, further comprising:

four spacers, one spacer disposed between each end of each link and the base to which the end of the link is attached.

5. The hinge assembly of claim 4, wherein the spacers are nylon spacers.

* * * * *